US011346220B2

(12) United States Patent
Park et al.

(10) Patent No.: US 11,346,220 B2
(45) Date of Patent: May 31, 2022

(54) COMPRESSOR

(71) Applicant: LG Electronics Inc., Seoul (KR)

(72) Inventors: Sangbaek Park, Seoul (KR); Jungsun Choi, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 99 days.

(21) Appl. No.: 16/790,234

(22) Filed: Feb. 13, 2020

(65) Prior Publication Data

US 2020/0263544 A1 Aug. 20, 2020

(30) Foreign Application Priority Data

Feb. 14, 2019 (KR) ..... 10-2019-0017340

(51) Int. Cl.

| | |
|---|---|
| ***F01C 17/06*** | (2006.01) |
| ***F01C 21/08*** | (2006.01) |
| ***F04C 18/02*** | (2006.01) |
| ***F04C 23/00*** | (2006.01) |

(52) U.S. Cl.

CPC ..... *F01C 17/066* (2013.01); *F01C 21/08* (2013.01); *F04C 18/0215* (2013.01); *F04C 23/008* (2013.01)

(58) Field of Classification Search

CPC ..... F01C 17/066; F04C 18/0215; F04C 29/0057; F04C 29/0071; F04C 18/0253; F16D 3/04

USPC ..... 418/55.3, 55.1; 464/102

See application file for complete search history.

(56) References Cited

U.S. PATENT DOCUMENTS

| | | | | |
|---|---|---|---|---|
| 5,275,543 | A | 1/1994 | Tanaka et al. | |
| 6,106,252 | A * | 8/2000 | Yamanaka | F01C 17/066 418/55.3 |
| 6,261,072 | B1 * | 7/2001 | Abe | F01C 17/066 418/55.3 |

(Continued)

FOREIGN PATENT DOCUMENTS

| | | |
|---|---|---|
| EP | 3208417 | 8/2017 |
| JP | H11236885 | 8/1999 |

(Continued)

OTHER PUBLICATIONS

Extended European Search Report in European Application No. 20157139.5, dated Jun. 29, 2020, 8 pages.

(Continued)

*Primary Examiner* — Patrick Hamo
*Assistant Examiner* — Wesley G Harris
(74) *Attorney, Agent, or Firm* — Fish & Richardson P.C.

(57) ABSTRACT

A compressor includes a rotation shaft, a drive unit, and a compression unit. The compression unit includes a fixed scroll, an orbiting scroll, a main frame that is disposed on the fixed scroll, and an Oldham's ring coupled to the orbiting scroll and the main frame and configured to restrict rotation of the orbiting scroll. The Oldham's ring includes a ring body disposed between the orbiting scroll and the main frame, keys that protrude from the ring body that are each coupled to the orbiting scroll or the main frame, and caps that are inserted into the main frame and that each have (i) a coupling hole that receives a key among the keys and (ii) a machined portion that faces the coupling hole and that is spaced apart from at least a portion of an outer surface of the key.

20 Claims, 9 Drawing Sheets

(56) References Cited

U.S. PATENT DOCUMENTS

| | | | | |
|---|---|---|---|---|
| 8,241,022 | B2 * | 8/2012 | Nakajima | F01C 17/066 418/55.3 |
| 2017/0067466 | A1 | 3/2017 | Oh et al. | |

FOREIGN PATENT DOCUMENTS

| | | |
|---|---|---|
| KR | 1020140085659 | 7/2014 |
| KR | 1020170029313 | 3/2017 |

OTHER PUBLICATIONS

Korean Office Action in Korean Application No. 10-2019-0017340, dated Apr. 13, 2020, 14 pages (with English translation).

* cited by examiner

COMPRESSOR

CROSS-REFERENCE TO RELATED APPLICATIONS

This application claims priority to and the benefit of Korean Patent Application No. 10-2019-0017340, filed on Feb. 14, 2019, which is hereby incorporated by reference as when fully set forth herein.

TECHNICAL FIELD

The present disclosure relates to a compressor. More specifically, the present disclosure relates to a scroll compressor that may strengthen a durability of an Oldham's ring that restricts rotation of an orbiting scroll.

BACKGROUND

A compressor may perform a refrigeration cycle for a refrigerator or an air conditioner. For example, the compressor may compress refrigerant to enable heat exchange in the refrigeration cycle.

The compressor may be classified into a reciprocating type, a rotary type, and a scroll type based on a method for compressing the refrigerant. For example, the scroll type compressor may perform an orbiting motion by an orbiting scroll engaged with a fixed scroll in an internal space of a sealed container. The compressor may define a compression chamber between a fixed wrap of the fixed scroll and an orbiting wrap of the orbiting scroll.

Compared with other types of the compressors, the scroll compressor may obtain a relatively high compression ratio because the refrigerant is continuously compressed through the scrolls engaged with each other, and may obtain a stable torque because suction, compression, and discharge of the refrigerant proceed smoothly. The scroll compressor may be used for compressing the refrigerant in the air conditioner and the like.

In some examples, a scroll compressor may include a casing forming an outer shape of the compressor and having a discharger for discharging refrigerant, a compression unit fixed to the casing to compress the refrigerant, and a drive unit fixed to the casing to drive the compression unit, and the compression unit and the drive unit are coupled to a rotation shaft that is coupled to the drive unit and rotates.

The compression unit may include a fixed scroll fixed to the casing and having a fixed wrap, and an orbiting scroll including an orbiting wrap operated in a state of being engaged with the fixed wrap by the rotation shaft. In some cases, the scroll compressor may include the rotation shaft that is eccentric, and the orbiting scroll fixed to the eccentric rotation shaft and rotating. The orbiting scroll may orbit along the fixed scroll and compress the refrigerant.

In some cases, the scroll compressor may further include an Oldham's ring (or Oldham ring) that prevent the orbiting scroll from rotating while being engaged with the fixed scroll.

FIGS. 1A to 1C illustrate a structure of an Oldham's ring of a scroll compressor in related art.

Referring to FIG. 1A, an Oldham's ring 1700 includes a body 1710 formed in a ring shape, and a key 1720 protruding from one face or the other face of the body 1710 to be inserted into a groove defined in an orbiting scroll or a main scroll in a straight direction. Such keys 1720*a* and 1720*b* prevent the orbiting scroll from rotating while linearly reciprocating the grooves defined in the main frame and the orbiting scroll.

The Oldham's ring further includes a cap 1730 coupled to an outer circumferential surface of the key and accommodated on the grooves of the main frame and the orbiting scroll. The cap 1730 may include a key hole 1732 defined therein into which the key is inserted and coupled. The cap 1730 is made of a material having stronger friction and durability than the Oldham's ring.

Referring to FIG. 1B, to prevent the cap 1730 from being separated from the key 1720, the cap 1730 is pressed into and coupled to the key 1720 in an interference fitting manner. For example, the cap 1730 may be caught by a free end of the key and not be inserted into the key, or the cap and the key may be broken in a process of coupling the cap with the key.

In addition, the cap 1730 is coupled to the key while strongly rubbing against the outer circumferential surface of the key 1720. In this process, a strong frictional force acts on a portion T where the cap 1730 and the key 1720 begins to be in contact with each other, and a strong residual stress exists even when the coupling is completed. Therefore, the key may be broken as time passes.

In some cases, the key of the Oldham's ring of the scroll compressor may have a polygon shape in order to prevent free rotation of the cap. Therefore, the groove in which the key is accommodated in the cap is inevitably formed in a form of a polygon. In some examples, a tolerance occurs at a vertex of the polygonal groove. In particular, a radius of curvature of the vertex may not generally be managed. Thus, a width of the tolerance may be very large. As a result, in the process of inserting the key into the hole defined in the cap, the shape of the groove and a shape of the key do not match, so that the key or the cap may be broken. This phenomenon may cause a variation in a durability of the Oldham's ring during mass production of the Oldham's ring.

Referring to FIG. 1C, in a process of fully coupling the cap with the key, a burr "b" may be generated when an end of the cap is pushed to a position where the cap and the Oldham's ring are in contact with each other. In particular, the Oldham's ring of the scroll compressor may have a thrust face, which may be thick in order to strengthen a grounding force on the main frame and the orbiting scroll, on a side face of the key. Therefore, the burr "b" was able to be generated larger by strong contact between the cap and the thrust face. Because of the generation of such burr, a coupling force between the cap and the key and stabilities of the cap and the key may not be guaranteed.

In some cases, the thrust face may make the Oldham's ring 1700 heavy, which may reduce the efficiency of the compressor.

SUMMARY

The present disclosure describes a compressor in which cross-sectional vertices of a key and a cap may be coupled to each other without colliding with each other even when the key and the cap are formed in polygon shapes.

The present disclosure describes a compressor which, with tight tolerances during mass production of a key and a cap of an Oldham's ring, may secure a coupling force of the key and the cap.

The present disclosure describes a compressor that prevents or reduces occurrence of burrs at an end of a cap when the cap is pressed into a key.

The present disclosure describes a compressor that may reduce a thickness and a weight of an Oldham's ring while enhancing a durability of a key.

The present disclosure describes a compressor having a cap and a key that may minimize a residual stress when the cap and key are coupled to each other.

The present disclosure describes a compressor that may minimize frictional resistance and plastic deformation by inducing a coupling of a cap and a key even when the cap and key are not coupled in position.

Purposes are not limited to the above-mentioned purpose. Other purposes and advantages as not mentioned above may be understood from following descriptions and more clearly understood from embodiments. Further, it will be readily appreciated that the purposes and advantages may be realized by features and combinations thereof as disclosed in the claims.

According to one aspect of the subject matter described in this application, a compressor includes a casing configured to accommodate refrigerant, the casing comprising a discharger disposed at a side of the casing and configured to discharge the refrigerant, a rotation shaft disposed in the casing, a drive unit coupled to an inner circumferential surface of the casing and configured to rotate the rotation shaft, and a compression unit coupled to the rotation shaft and configured to compress the refrigerant. The compression unit includes a fixed scroll configured to receive and discharge the refrigerant, an orbiting scroll that is engaged with the fixed scroll, that is coupled to the rotation shaft, and that is configured to orbit relative to the fixed scroll based on rotation of the rotation shaft to thereby compress the refrigerant in the fixed scroll, a main frame that is disposed on the fixed scroll, that accommodates the orbiting scroll therein, and that receives the rotation shaft, and an Oldham's ring that is coupled to the orbiting scroll and to the main frame and that is configured to restrict rotation of the orbiting scroll. The Oldham's ring includes: a ring body disposed between the orbiting scroll and the main frame, a plurality of keys that protrude from the ring body, each of the plurality of keys being coupled to the orbiting scroll or the main frame, and a plurality of caps that are inserted into the main frame, each of the plurality of caps having (i) a coupling hole that receives a key among the plurality of keys and (ii) a machined portion that faces the coupling hole and that is spaced apart from at least a portion of an outer surface of the key.

Implementations according to this aspect may include one or more of the following features. For example, the coupling hole may extend from a first end that faces the main frame to a second end that faces the ring body, and the machined portion may extend outward from at least one of the first end of the coupling hole or the second end of the coupling hole. In some examples, the machined portion may include a contact portion that is disposed between the first end of the coupling hole and the second end of the coupling hole, that is in surface contact with the key, and that is coupled to the key and an insertion curved portion that extends from the contact portion to one of the first end of the coupling hole or the second end of the coupling hole and that guides insertion of the key into the coupling hole.

In some implementations, the machined portion may include: a contact portion that is disposed between the first end of the coupling hole and the second end of the coupling hole, that is in surface contact with the key, and that is coupled to the key, and a relief curved portion that extends from the contact portion to one of the first end of the coupling hole or the second end of the coupling hole and that is configured to reduce a residual stress of the key.

In some implementations, the machined portion may define a coupling gap that extends outward from a portion of the coupling hole and that is spaced apart from the outer surface of the key. In some examples, the coupling gap extends through the coupling hole in a direction from the ring body to the main frame. In some examples, the coupling gap may include a recessed portion that extends outward from the coupling hole relative to a vertex of the key. In some examples, the machined portion may include a curved portion that defines the coupling gap, and a radius of curvature of the curved portion may be less than a radius of curvature of a vertex of the key.

In some implementations, the outer surface of the key may be configured to avoid contact with one of the plurality of caps based on the key being inserted into the coupling hole. In some examples, an edge of the outer surface of the key may be curved or chamfered and be spaced apart from a corner of the coupling hole.

According to another aspect, a compressor includes a casing configured to accommodate refrigerant, the casing comprising a discharger disposed at a side of the casing and configured to discharge the refrigerant, a rotation shaft disposed in the casing, a drive unit coupled to an inner circumferential surface of the casing and configured to rotate the rotation shaft, and a compression unit coupled to the rotation shaft and configured to compress the refrigerant. The compression unit includes: a fixed scroll configured to receive and discharge the refrigerant, an orbiting scroll that is engaged with the fixed scroll, that is coupled to the rotation shaft, and that is configured to orbit relative to the fixed scroll based on rotation of the rotation shaft to thereby compress the refrigerant in the fixed scroll, a main frame that is disposed on the fixed scroll, that accommodates the orbiting scroll therein, and that receives the rotation shaft, and an Oldham's ring that is coupled to the orbiting scroll and the main frame and that is configured to restrict rotation of the orbiting scroll. The Oldham's ring includes a ring body that is disposed between the orbiting scroll and the main frame and that receives the rotation shaft, a plurality of keys that protrude from the ring body, each of the plurality of keys being coupled to the orbiting scroll or to the main frame, and a plurality of caps inserted into the main frame, each of the plurality of caps defining a coupling hole that accommodates a key among the plurality of keys. Each of the plurality of keys includes an avoiding portion that is spaced apart from an inner surface of the cap that defines the coupling hole.

Implementations according to this aspect may include one or more of the following features. For example, the avoiding portion may include a chamfer that is disposed at a vertex of the key and that is inclined with respect to the inner surface of the cap. In some examples, the avoiding portion may include a curved portion disposed at a vertex of the key, and a radius of curvature of the curved portion may be greater than a radius of curvature of a corner of the coupling hole that faces the vertex of the key. In some implementations, the avoiding portion may extend along a longitudinal direction of the key toward the ring body.

In some implementations, the plurality of keys may include a first plurality of keys that protrude from a first surface of the ring body and that are coupled to the main frame, and a second plurality of keys that protrude from a second surface of the ring body opposite to the first surface and that are coupled to the orbiting scroll. The first plurality of keys and the second plurality of keys may be alternately arranged along the ring body.

According to another aspect, a compressor includes a casing configured to accommodate refrigerant, the casing comprising a discharger disposed at a side of the casing and configured to discharge the refrigerant; a rotation shaft disposed in the casing; a drive unit coupled to an inner circumferential surface of the casing and configured to rotate the rotation shaft; and a compression unit coupled to the rotation shaft and configured to compress the refrigerant. The compression unit includes a fixed scroll configured to receive and discharge the refrigerant, an orbiting scroll that is engaged with the fixed scroll, that is coupled to the rotation shaft, and that is configured to orbit relative to the fixed scroll based on rotation of the rotation shaft to thereby compress the refrigerant in the fixed scroll, a main frame that is disposed on the fixed scroll, that accommodates the orbiting scroll therein, and that receives the rotation shaft, and an Oldham's ring that is coupled to the orbiting scroll and to the main frame and that is configured to restrict rotation of the orbiting scroll. The Oldham's ring includes: a ring body disposed between the orbiting scroll and the main frame, a plurality of keys that protrude from the ring body, each of the plurality of keys being coupled to the orbiting scroll or to the main frame, and a plurality of caps that are inserted into the main frame, each of the plurality of caps defining a coupling hole that accommodates a key among the plurality of keys. The ring body includes an inclined portion that is disposed at a boundary between the ring body and each of the plurality of keys and that defines a space between the ring body and a cap among the plurality of caps.

Implementations according to this aspect may include one or more of the following features. For example, the inclined portion may extend outward relative to a portion of the key that is in contact with the cap. In some implementations, the ring body may define a recess that is recessed from a surface of the ring body, that extends outward from the inclined portion, and that is spaced apart from the cap.

In some implementations, the recess may be defined at both sides of each of the plurality of keys. In some implementations, the ring body may further include a support protrusion that protrudes from the surface of the ring body, that extends outward from the recess, and that is in contact with the main frame or the orbiting scroll.

The compressor described in the present disclosure may include contact avoidance structures disposed on a key and a cap such that, in a case of an Oldham's ring with different materials, a fitting interference (e.g., 5 to 50 μm level at one side) may be defined to reduce a residual stress due to the fitting while ensuring a sufficient press force (a friction force due to contact) based on the fitting interference.

In some implementations, an outer circumferential surface or one end edge/vertex of a cross-section of the key of the Oldham's ring may be chamfered. In some implementations, an inner circumferential surface of a hole defined in the cap may also be chamfered. In some implementations, a circumference of a free end of the key and one end of an inner circumferential surface of the cap hole may be curved. In some implementations, the Oldham's ring may have a groove defined between the vertices of the key and the cap hole such that contact between the vertices of the key and the cap hole is avoided. In some examples, radii of curvature of the key and the cap hole may be different from each other.

In some examples, a structural contact length which allows a sufficient pressing force for coupling the key with the cap to be generated with only a management dimension may be formed to be 60% or greater of the management dimension. For example, the vertices of the cap and the key may be machined to be removed to an extent that a contact length of the cap and an outer circumferential surface of the key becomes equal to or greater than 60% of the management dimension of the vertex. Thus, tolerance management may be performed with only the management dimension during mass production. In one example, a length by which the cap is coupled to the key in a thickness direction thereof may also be set to 60% or greater of the management dimension.

In some implementations, a cap of a compressor may define a coupling hole coupled with a key. In some examples, the coupling hole may include a machined portion that may be spaced apart from at least a portion of an outer surface of the key. The machined portion may extend outwardly from at least one of both ends of the coupling hole. The machined portion may include at least one of an insertion curved portion extending from a contact portion where the key and the cap are in contact with each other to one end of the coupling hole to induce insertion of the key, and a relief curved portion extending to the other end of the coupling hole to reduce a residual stress of the key.

In some implementations, the key of the compressor may face a coupling gap spaced apart from at least one of vertices. The coupling gap may extend along a thickness direction of the coupling hole. In addition, the coupling gap may include a recessed portion recessed outwardly of the cap than the vertex of the key from the coupling hole or a curved portion having a radius of curvature smaller than a radius of curvature of the vertex of the key in the coupling hole.

In some examples, the key of the compressor may include an avoiding portion formed by processing a portion of an outer circumferential surface of the key to prevent contact with the cap. The avoiding portion may include an inclined avoiding portion formed by chamfering a cross-sectional vertex of the key, or a curved avoiding portion formed such that a cross-sectional vertex of the key has a radius of curvature greater than a radius of curvature of one face of the coupling hole that faces the cross-sectional vertex of the key. Further, the avoiding portion may extend along a longitudinal direction of the key.

The key of the compressor may include an inclined portion extending from the Oldham's ring in an inclined manner to be spaced apart from the cap. Thus, the cap is caught at an end of the inclined portion, so that contact between the Oldham's ring and the cap may be prevented. As a result, generation of burrs may be blocked.

The Oldham's ring of the compressor may include a recess recessed from an outer surface of each of the plurality of keys and spaced apart from the cap. This may reduce a thickness and a weight of the Oldham's ring while preventing generation of burrs. Each recess may be defined at each of both sides of each of the plurality of keys.

The Oldham's ring of the compressor may further include a support protrusion protruding such that the support protrusion is extended from the recess to be in contact with the main frame or the orbiting scroll. This prevents an entirety of the Oldham's ring from being in surface contact with the main frame or the orbiting scroll, thereby improving durability.

The features of the above-described implantations may be combined with other embodiments as long as they are not contradictory or exclusive to each other.

Effects are as follows but are limited thereto.

In some implementations, the compressor may include the key and the cap that are coupled to each other without colliding with each other at the cross-sectional vertices even when the key and the cap are formed in the polygon shapes.

In some implementations, the compressor, even when the tolerances occur during the mass production of the key and the cap of the Oldham's ring, may secure the coupling force of the key and the cap.

In some implementations, the compressor may prevent the occurrence of the burrs at the end of the cap when the cap is pressed into the key.

In some implementations, the compressor may reduce the thickness and the weight of the Oldham's ring while enhancing the durability of the key.

In some implementations, the compressor having the cap and the key may minimize the residual stress when the cap and key are coupled to each other.

In some implementations, the compressor may minimize the frictional resistance and the plastic deformation by inducing the coupling of the cap and the key even when the cap and key are not coupled in a position.

DETAILED DESCRIPTIONS

For simplicity and clarity of illustration, elements in the figures are not necessarily drawn to scale. The same reference numbers in different figures denote the same or similar elements, and as such perform similar functionality. Furthermore, in the following detailed description, numerous specific details are set forth in order to provide a thorough understanding. However, it will be understood that the present disclosure may be practiced without these specific details. In other instances, well-known methods, procedures, components, and circuits have not been described in detail so as not to unnecessarily obscure aspects.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope as defined by the appended claims.

Figure 1A:
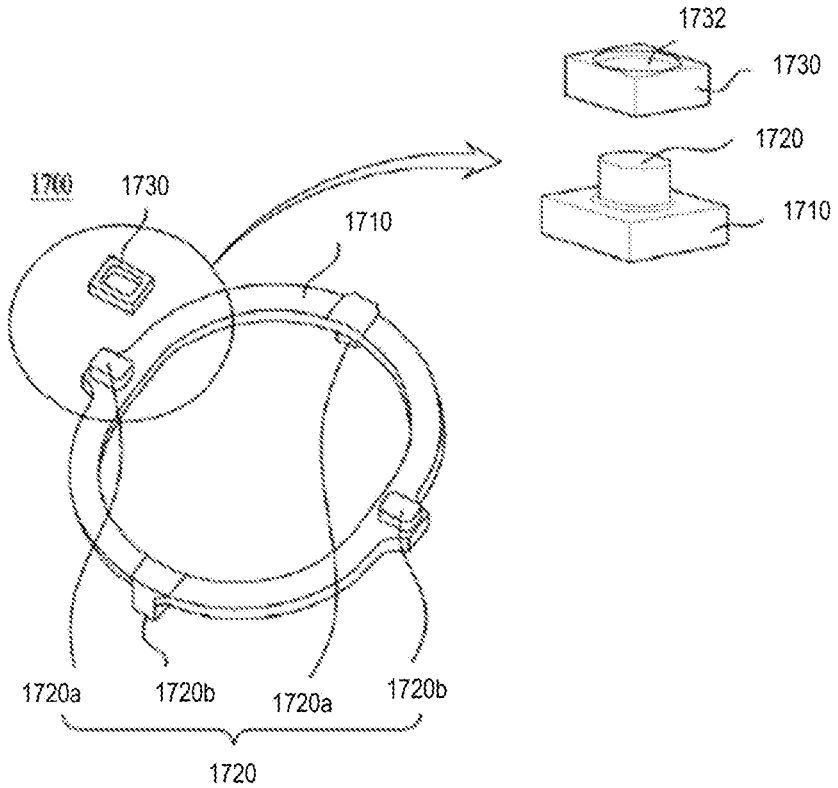
FIGS. 1A to 1C illustrate an example of an Oldham's ring of a compressor in related art.
Figure 1B:
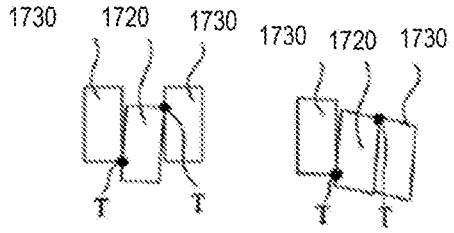
Figure 1C:
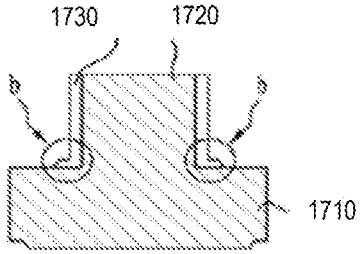
Figure 2:
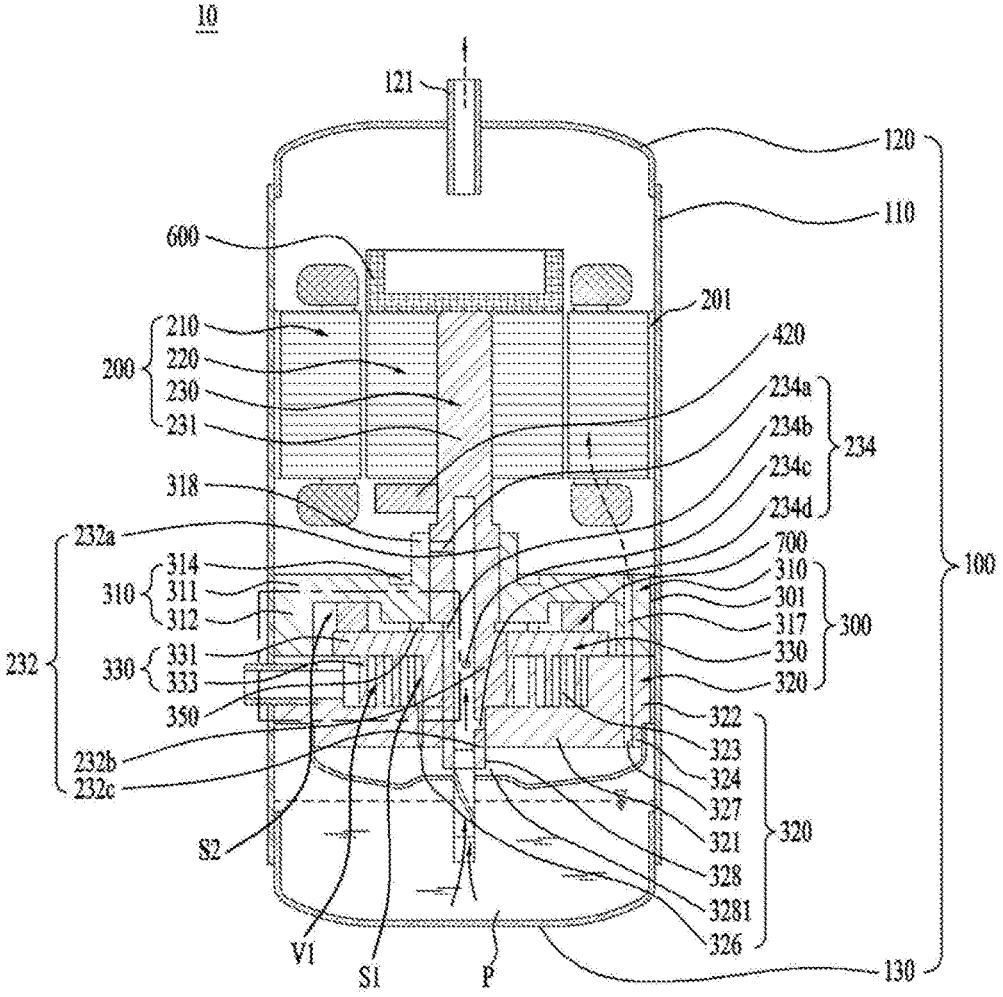
FIG. 2 illustrates a structure of an example compressor.

FIG. 2 illustrates a structure of an example compressor.

Referring to FIG. 2, a scroll compressor 10 may include a casing 100 having therein a space in which fluid is stored or flows, a drive unit 200 coupled to an inner circumferential surface of the casing 100 to rotate a rotation shaft 230, and a compression unit 300 coupled to the rotation shaft 230 inside the casing and compressing the fluid.

In some implementations, the casing 100 may include a discharger 121 through which refrigerant is discharged at one side. The casing 100 may include a receiving shell 110 provided in a cylindrical shape to receive the drive unit 200 and the compression unit 300 therein, a discharge shell 120 coupled to one end of the receiving shell 110 and having the discharger 121, and a sealing shell 130 coupled to the other end of the receiving shell 110 to seal the receiving shell 110. In some examples, the discharger 121 may include a pipe or a tube coupled to the casing 100 (e.g., the discharge shell 120). In some cases, the discharge may be an aperture defined in the discharge shell 120.

The drive unit 200 may include a stator 210 for generating a rotating magnetic field, and a rotor 220 disposed to rotate by the rotating magnetic field. The rotation shaft 230 may be coupled to the rotor 220 to be rotated together with the rotor 220. In some examples, the drive unit 200 may include a motor.

The stator 210 has a plurality of slots defined in an inner circumferential surface thereof along a circumferential direction and a coil is wound around the plurality of slots. Further, the stator 210 may be fixed to an inner circumferential surface of the receiving shell 110. A permanent magnet may be coupled to the rotor 220, and the rotor 220 may be rotatably coupled within the stator 210 to generate rotational power. The rotation shaft 230 may be pressed into and coupled to a center of the rotor 220.

The compression unit 300 may include a fixed scroll 320 coupled to the receiving shell 110 and disposed in a direction away from the discharger 121 with respect to the drive unit 200, an orbiting scroll 330 coupled to the rotation shaft 230 and engaged with the fixed scroll 320 to define a compression chamber, and a main frame 310 accommodating the orbiting scroll 330 therein and seated on the fixed scroll 320 to form an outer shape of the compression unit 300. In some cases, the compression unit 300 may be an assembled device including the main frame 310, the fixed scroll 320, and the orbiting scroll 330.

In some implementations, the lower scroll compressor 10 has the drive unit 200 disposed between the discharger 121 and the compression unit 300. In other words, the drive unit 200 may be disposed at one side of the discharger 121, and the compression unit 300 may be disposed in a direction away from the discharger 121 with respect to the drive unit 200. For example, when the discharger 121 is disposed on the casing 100, the compression unit 300 may be disposed below the drive unit 200, and the drive unit 200 may be disposed between the discharger 121 and the compression unit 300.

In some implementations, when oil is stored in an oil storage space "P" of the casing 100, the oil may be supplied directly to the compression unit 300 without passing through the drive unit 200. In some examples, since the rotation shaft 230 is coupled to and supported by the compression unit 300, a lower frame for rotatably supporting the rotation shaft may be omitted.

In some implementations, the lower scroll compressor 10 may be provided such that the rotation shaft 230 penetrates not only the orbiting scroll 330 but also the fixed scroll 320 to be in face contact with both the orbiting scroll 330 and the fixed scroll 320.

For example, an inflow force generated when the fluid such as the refrigerant is flowed into the compression unit 300, a gas force generated when the refrigerant is compressed in the compression unit 300, and a reaction force for supporting the same may be directly exerted on the rotation shaft 230. Accordingly, the inflow force, the gas force, and the reaction force may be exerted to a point of application of the rotation shaft 230. As a result, since an upsetting moment does not act on the orbiting scroll 320 coupled to the rotation shaft 230, tilting or upsetting of the orbiting scroll may be blocked. In other words, tilting in an axial direction of the tilting may be attenuated or prevented, and the upsetting moment of the orbiting scroll 330 may also be attenuated or suppressed. As a result, noise and vibration generated in the lower scroll compressor 10 may be blocked.

In addition, the fixed scroll 320 is in face contact with and supports the rotation shaft 230, so that durability of the rotation shaft 230 may be reinforced even when the inflow force and the gas force act on the rotation shaft 230.

In addition, a back pressure generated while the refrigerant is discharged to outside is also partially absorbed or supported by the rotation shaft 230, so that a force (normal force) in which the orbiting scroll 330 and the fixed scroll 320 become excessively close to each other in the axial direction may be reduced. As a result, a friction force between the orbiting scroll 330 and the fixed scroll 320 may be greatly reduced.

In some implementations, the compressor 10 may attenuate the tilting in the axial direction and the upsetting moment of the orbiting scroll 330 inside the compression unit 300 and reduces the frictional force of the orbiting scroll, thereby increasing an efficiency and a reliability of the compression unit 300.

In one example, the main frame 310 of the compression unit 300 may include a main end plate 311 provided at one side of the drive unit 200 or at a lower portion of the drive unit 200, a main side plate 312 extending in a direction farther away from the drive unit 200 from an inner circumferential surface of the main end plate 311 and seated on the fixed scroll 330, and a main shaft receiving portion 318 extending from the main end plate 311 to rotatably support the rotation shaft 230.

A main hole 317 for guiding the refrigerant discharged from the fixed scroll 320 to the discharger 121 may be further defined in the main end plate 311 or the main side plate 312.

The main end plate 311 may further include an oil pocket 314 that is engraved in an outer surface of the main shaft receiving portion 318. The oil pocket 314 may be defined in an annular shape, and may be defined to be eccentric to the main shaft receiving portion 318. When the oil stored in the sealing shell 130 is transferred through the rotation shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 in a direction away from the drive unit 200 with respect to the main end plate 311 to form the other face of the compression unit 300, a fixed side plate 322 extending from the fixed end plate 321 to the discharger 121 to be in contact with the main side plate 312, and a fixed wrap 323 disposed on an inner circumferential surface of the fixed side plate 322 to define the compression chamber in which the refrigerant is compressed.

In one example, the fixed scroll 320 may include a fixed through-hole 328 defined to penetrate the rotation shaft 230, and a fixed shaft receiving portion 3281 extending from the fixed through-hole 328 such that the rotation shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes.

The orbiting scroll 330 may include an orbiting end plate 331 disposed between the main frame 310 and the fixed scroll 320, and an orbiting wrap 333 disposed below the orbiting end plate to define the compression chamber together with the fixed wrap 323 in the orbiting end plate.

The orbiting scroll 330 may further include an orbiting through-hole 338 defined through the orbiting end plate 331 to rotatably couple the rotation shaft 230.

The rotation shaft 230 may be disposed such that a portion thereof coupled to the orbiting through-hole 338 is eccentric. Thus, when the rotation shaft 230 is rotated, the orbiting scroll 330 moves in a state of being engaged with the fixed wrap 323 of the fixed scroll 320 to compress the refrigerant.

Specifically, the rotation shaft 230 may include a main shaft 231 coupled to the drive unit 200 and rotating, and a bearing portion 232 connected to the main shaft 231 and rotatably coupled to the compression unit 300. The bearing portion 232 may be included as a member separate from the main shaft 231, and may accommodate the main shaft 231 therein, or may be integrated with the main shaft 231.

The bearing portion 232 may include a main bearing portion **232*c* inserted into the main shaft receiving portion 318 of the main frame 310 and rotatably supported, a fixed bearing portion 232*a* inserted into the fixed shaft receiving portion 3281 of the fixed scroll 320 and rotatably supported, and an eccentric shaft 232*b* disposed between the main bearing portion 232*c* and the fixed bearing portion 232*a*, and inserted into the orbiting through-hole 338 of the orbiting scroll 330** and rotatably supported.

In some examples, the main bearing portion **232*c* and the fixed bearing portion 232*a* may be coaxial to have the same axis center, and the eccentric shaft 232*b* may be formed such that a center of gravity thereof is radially eccentric with respect to the main bearing portion 232*c* or the fixed bearing portion 232*a*. In addition, the eccentric shaft 232*b* may have an outer diameter greater than an outer diameter of the main bearing portion 232*c* or an outer diameter of the fixed bearing portion 232*a*. As such, the eccentric shaft 232*b* may provide a force to compress the refrigerant while orbiting the orbiting scroll 330 when the bearing portion 232 rotates, and the orbiting scroll 330 may be disposed to regularly orbit the fixed scroll 320 by the eccentric shaft 232*b***.

In some implementations, in order to prevent the orbiting scroll 320 from rotating, the compressor 10 may further include an Oldham's ring 340 coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be disposed to linearly move in four directions of front, rear, left, and right directions to prevent the rotation of the orbiting scroll 320.

In one example, the rotation shaft 230 may be disposed to completely pass through the fixed scroll 320 to protrude out of the compression unit 300. As a result, the rotation shaft 230 may be in direct contact with outside of the compression unit 300 and the oil stored in the sealing shell 130. The rotation shaft 230 may supply the oil into the compression unit 300 while rotating.

The oil may be supplied to the compression unit 300 through the rotation shaft 230. An oil supply passage 234 for supplying the oil to an outer circumferential surface of the main bearing portion 232*c*, an outer circumferential surface of the fixed bearing portion 232*a*, and an outer circumferential surface of the eccentric shaft 232*b* may be formed at or inside the rotation shaft 230.

In addition, a plurality of oil supply holes 234*a*, 234*b*, 234*c*, and 234*d* may be defined in the oil supply passage 234. Specifically, the oil supply hole may include a first oil supply hole 234*a*, a second oil supply hole 234*b*, a third oil supply hole 234*c*, and a fourth oil supply hole 234*d*. First, the first oil supply hole 234*a* may be defined to penetrate through the outer circumferential surface of the main bearing portion 232*c*.

The first oil supply hole 234*a* may be defined to penetrate into the outer circumferential surface of the main bearing portion 232*c* in the oil supply passage 234. In addition, the first oil supply hole 234*a* may be defined to, for example, penetrate an upper portion of the outer circumferential surface of the main bearing portion 232*c*, but is not limited thereto. That is, the first oil supply hole 234*a* may be defined to penetrate a lower portion of the outer circumferential surface of the main bearing portion 232*c*. In some cases, unlike as shown in the drawing, the first oil supply hole 234*a* may include a plurality of holes. In addition, when the first oil supply hole 234*a* includes the plurality of holes, the plurality of holes may be defined only in the upper portion or only in the lower portion of the outer circumferential surface of the main bearing portion 232*c*, or may be defined in both the upper and lower portions of the outer circumferential surface of the main bearing portion 232*c*.

In addition, the rotation shaft 230 may include an oil feeder 233 disposed to pass through a muffler 500 to be described later to be in contact with the stored oil of the casing 100. The oil feeder 233 may include an extension shaft 233*a* passing through the muffler 500 and in contact with the oil, and a spiral groove 233*b* spirally defined in an outer circumferential surface of the extension shaft 233*a* and in communication with the oil supply passage 234.

Thus, when the rotation shaft 230 is rotated, due to the spiral groove 233*b*, a viscosity of the oil, and a pressure difference between a high pressure region S1 and an intermediate pressure region V1 inside the compression unit 300, the oil rises through the oil feeder 233 and the oil supply passage 234 and is discharged into the plurality of oil supply holes. The oil discharged through the plurality of oil supply holes 234*a*, 234*b*, 234*c*, and 234*d* not only maintains an airtight state by forming an oil film between the fixed scroll 250 and the orbiting scroll 320, but also absorbs frictional heat generated at friction portions between the components of the compression unit 300 and discharge the heat.

The oil guided along the rotation shaft 230 and supplied through the first oil supply hole 234*a* may lubricate the main frame 310 and the rotation shaft 230. In addition, the oil may be discharged through the second oil supply hole 234*b* and supplied to a top face of the orbiting scroll 320, and the oil supplied to the top face of the orbiting scroll 320 may be guided to the intermediate pressure region through the pocket groove 314. In some examples, the oil discharged not only through the second oil supply hole 234*b* but also through the first oil supply hole 234*a* or the third oil supply hole 234*c* may be supplied to the pocket groove 314.

In some examples, the oil guided along the rotation shaft 230 may be supplied to the Oldham's ring 340 and the fixed side plate 322 of the fixed scroll 320 installed between the orbiting scroll 330 and the main frame 310. Thus, wear of the fixed side plate 322 of the fixed scroll 320 and the Oldham's ring 340 may be reduced. In addition, the oil supplied to the third oil supply hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil supply structure in which the lower scroll compressor 10 uses the rotation of the rotation shaft 230 to supply the oil to the bearing has been described, the centrifugal oil supply structure is merely an example. Further, a differential pressure supply structure for supplying oil using a pressure difference inside the compression unit 300 and a forced oil supply structure for supplying oil through a torocoid pump, and the like may also be applied.

In one example, the compressed refrigerant is discharged to the discharge hole 326 along a space defined by the fixed wrap 323 and the orbiting wrap 333. The discharge hole 326 may be more advantageously disposed toward the discharger 121. This is because the refrigerant discharged from the discharge hole 326 is most advantageously delivered to the discharger 121 without a large change in a flow direction.

However, because of structural characteristics that the compression unit 300 is provided in a direction away from the discharger 121 with respect to the drive unit 200, and that the fixed scroll 320 should be disposed at an outermost portion of the compression unit 300, the discharge hole 326 is disposed to spray the refrigerant in a direction opposite to the discharger 121.

In other words, the discharge hole 326 is defined to spray the refrigerant in a direction away from the discharger 121 with respect to the fixed end plate 321. Therefore, when the refrigerant is sprayed into the discharge hole 326 as it is, the refrigerant may not be smoothly discharged to the discharger 121, and when the oil is stored in the sealing shell 130, the refrigerant may collide with the oil and be cooled or mixed.

In order to prevent this, the compressor 10 may further include the muffler 500 coupled to an outermost portion of the fixed scroll 320 and providing a space for guiding the refrigerant to the discharger 121.

The muffler 500 may be disposed to seal one face disposed in a direction farther away from the discharger 121 of the fixed scroll 320 to guide the refrigerant discharged from the fixed scroll 320 to the discharger 121.

The muffler 500 may include a coupling body 520 coupled to the fixed scroll 320 and a receiving body 510 extending from the coupling body 520 to define sealed space therein. Thus, the refrigerant sprayed from the discharge hole 326 may be discharged to the discharger 121 by switching the flow direction along the sealed space defined by the muffler 500.

Further, since the fixed scroll 320 is coupled to the receiving shell 110, the refrigerant may be restricted from flowing to the discharger 121 by being interrupted by the fixed scroll 320. Therefore, the fixed scroll 320 may further include a bypass hole 327 defined therein allowing the refrigerant penetrated the fixed end plate 321 to pass through the fixed scroll 320. The bypass hole 327 may be disposed to be in communication with the main hole 317. Thus, the refrigerant may pass through the compression unit 300, pass the drive unit 200, and be discharged to the discharger 121.

The more the refrigerant flows inward from an outer circumferential surface of the fixed wrap 323, the higher the pressure compressing the refrigerant. Thus, an interior of the fixed wrap 323 and an interior of the orbiting wrap 333 maintain in a high pressure state. Accordingly, a discharge pressure is exerted to a rear face of the orbiting scroll, and the back pressure is exerted toward the fixed scroll in the orbiting scroll. The compressor 10 may further include a back pressure seal 350 that concentrates the back pressure on a portion where the orbiting scroll 320 and the rotation shaft 230 are coupled to each other, thereby preventing leakage between the orbiting wrap 333 and the fixed wrap 323.

The back pressure seal 350 is disposed in a ring shape to maintain an inner circumferential surface thereof at a high pressure, and separate an outer circumferential surface thereof at an intermediate pressure lower than the high pressure. Therefore, the back pressure is concentrated on the inner circumferential surface of the back pressure seal 350, so that the orbiting scroll 330 is in close contact with the fixed scroll 320.

In some examples, considering that the discharge hole 326 is defined to be spaced apart from the rotation shaft 230, the back pressure seal 350 may also be disposed such that a center thereof is biased toward the discharge hole 326.

In addition, due to the back pressure seal 350, the oil supplied from the first oil supply hole 234*a* may be supplied to the inner circumferential surface of the back pressure seal 350. Therefore, the oil may lubricate a contact face between the main scroll and the orbiting scroll. Further, the oil supplied to the inner circumferential surface of the back pressure seal 350 may generate a back pressure for pushing the orbiting scroll 330 to the fixed scroll 320 together with a portion of the refrigerant.

As such, the compression space of the fixed wrap 323 and the orbiting wrap 333 may be divided into the high pressure region S1 inside the back pressure seal 350 and the intermediate pressure region V1 outside the back pressure seal 350 on the basis of the back pressure seal 350. In one example, the high pressure region S1 and the intermediate pressure region V1 may be naturally divided because the pressure is increased in a process in which the refrigerant is introduced and compressed. However, since the pressure change may occur critically due to a presence of the back pressure seal 350, the compression space may be divided by the back pressure seal 350.

In one example, the oil supplied to the compression unit 300, or the oil stored in the oil storage space "P" of the casing 100 may flow toward an upper portion of the casing 100 together with the refrigerant as the refrigerant is discharged to the discharger 121. In some examples, because the oil is denser than the refrigerant, the oil may not be able to flow to the discharger 121 by a centrifugal force generated by the rotor 220, and may be attached to inner walls of the discharge shell 120 and the receiving shell 110. The lower scroll compressor 10 may further include recovery passages respectively on outer circumferential surfaces of the drive unit 200 and the compression unit 300 to recover the oil attached to an inner wall of the casing 100 to the oil storage space of the casing 100 or the sealing shell 130.

The recovery passage may include a drive unit recovery passage 201 defined in an outer circumferential surface of the drive unit 200, a compression recovery passage 301 defined in an outer circumferential surface of the compression unit 300, and a muffler recovery passage 501 defined in an outer circumferential surface of the muffler 500.

The drive unit recovery passage 201 may be defined by recessing a portion of an outer circumferential surface of the stator 210 is recessed, and the compression recovery passage 301 may be defined by recessing a portion of an outer circumferential surface of the fixed scroll 320. In addition, the muffler recovery passage 501 may be defined by recessing a portion of the outer circumferential surface of the muffler. The drive unit recovery passage 201, the compression recovery passage 301, and the muffler recovery passage 501 may be defined in communication with each other to allow the oil to pass therethrough.

As described above, because the rotation shaft 230 has a center of gravity biased to one side due to the eccentric shaft 232*b*, during the rotation, an unbalanced eccentric moment occurs, causing an overall balance to be distorted. Accordingly, the lower scroll compressor 10 may further include a balancer 400 that may offset the eccentric moment that may occur due to the eccentric shaft 232*b*.

In some implementations, where the compression unit 300 is fixed to the casing 100, the balancer 400 may be coupled to the rotation shaft 230 itself or the rotor 220 disposed to rotate. Therefore, the balancer 400 may include a central balancer 410 disposed on a bottom of the rotor 220 or on a face facing the compression unit 300 to offset or reduce an eccentric load of the eccentric shaft 232*b*, and an outer balancer 420 coupled to a top of the rotor 220 or the other face facing the discharger 121 to offset an eccentric load or an eccentric moment of at least one of the eccentric shaft 232*b* and the outer balancer 420.

Because the central balancer 410 is disposed relatively close to the eccentric shaft 232*b*, the central balancer 410 may directly offset the eccentric load of the eccentric shaft 232*b*. In some implementations, the central balancer 410 may be disposed eccentrically in a direction opposite to the direction in which the eccentric shaft 232*b* is eccentric. As a result, even when the rotation shaft 230 rotates at a low speed or a high speed, because a distance away from the eccentric shaft 232*b* is close, the central balancer 410 may effectively offset an eccentric force or the eccentric load generated in the eccentric shaft 232*b* almost uniformly.

The outer balancer 420 may be disposed eccentrically in a direction opposite to the direction in which the eccentric shaft 232*b* is eccentric. However, the outer balancer 420 may be eccentrically disposed in a direction corresponding to the eccentric shaft 232*b* to partially offset the eccentric load generated by the central balancer 410.

As a result, the central balancer 410 and the outer balancer 420 may offset the eccentric moment generated by the eccentric shaft 232*b* to assist the rotation shaft 230 to rotate stably.

Figure 3A:
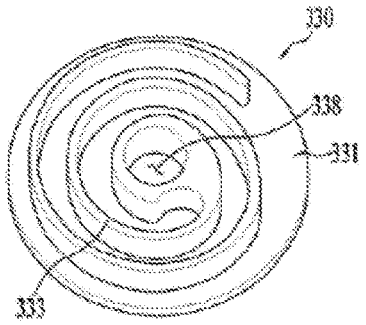
FIGS. 3A to 3C illustrate an example of operation of an example compressor.
Figure 3B:
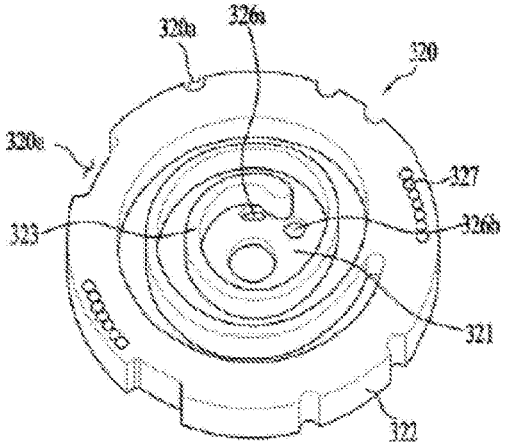
Figure 3C:
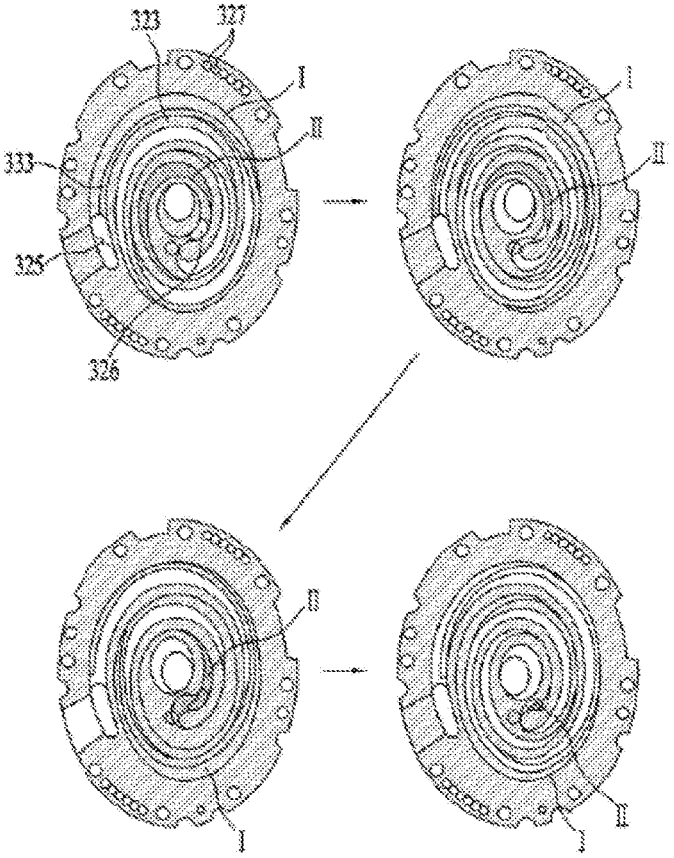

FIGS. 3A to 3C illustrate an example of a process in which the compressor compresses the refrigerant.

FIG. 3A illustrates the orbiting scroll, FIG. 3B illustrates the fixed scroll, and FIG. 3C illustrates a process in which the orbiting scroll and the fixed scroll compress the refrigerant.

The orbiting scroll 330 may include the orbiting wrap 333 on one face of the orbiting end plate 331, and the fixed scroll 320 may include the fixed wrap 323 on one face of the fixed end plate 321.

In addition, the orbiting scroll 330 is provided as a sealed rigid body to prevent the refrigerant from being discharged to the outside, but the fixed scroll 320 may include the inflow hole 325 in communication with a refrigerant supply pipe such that the refrigerant in a liquid phase of a low temperature and a low pressure may inflow, and the discharge hole 326 through which the refrigerant of a high temperature and a high pressure is discharged. Further, the bypass hole 327 through which the refrigerant discharged from the discharge hole 326 is discharged may be defined in an outer circumferential surface of the fixed scroll 320.

In one example, the fixed wrap 323 and the orbiting wrap 333 may be formed in an involute shape and at least two contact points between the fixed wrap 323 and the orbiting wrap 333 may be formed, thereby defining the compression chamber.

The involute shape refers to a curve corresponding to a trajectory of an end of a yarn when unwinding the yarn wound around a base circle having an arbitrary radius as shown.

However, in the present disclosure, the fixed wrap 323 and the orbiting wrap 333 are formed by combining 20 or more arcs, and radii of curvature of the fixed wrap 323 and the orbiting wrap 333 may vary from part to part.

That is, the compressor is disposed such that the rotation shaft 230 penetrates the fixed scroll 320 and the orbiting scroll 330, and thus the radii of curvature of the fixed wrap 323 and the orbiting wrap 333 and the compression space are reduced.

Thus, in order to compensate for this, in the compressor, radii of curvature of the fixed wrap 323 and the orbiting wrap 333 immediately before the discharge may be smaller than that of the penetrated shaft receiving portion of the rotation shaft such that the space to which the refrigerant is discharged may be reduced and a compression ratio may be improved.

That is, the fixed wrap 323 and the orbiting wrap 333 may be more severely bent in the vicinity of the discharge hole 326, and may be more bent toward the inflow hole 325, so that the radii of curvature of the fixed wrap 323 and the orbiting wrap 333 may vary point to point in correspondence with the bent portions.

Referring to FIG. 3C, refrigerant I is flowed into the inflow hole 325 of the fixed scroll 320, and refrigerant II flowed before the refrigerant I is located near the discharge hole 326 of the fixed scroll 320.

In this case, the refrigerant I is present in a region at outer circumferential surfaces of the fixed wrap 323 and the orbiting wrap 333 where the fixed wrap 323 and the orbiting wrap 333 are engaged with each other, and the refrigerant II is enclosed in another region in which the two contact points between the fixed wrap 323 and the orbiting wrap 333 exist.

Thereafter, when the orbiting scroll 330 starts to orbit, as the region in which the two contact points between the fixed wrap 323 and the orbiting wrap 333 exist is moved based on a position change of the orbiting wrap 333 along an extension direction of the orbiting wrap 333, a volume of the region begins to be reduced, and the refrigerant I starts to flow and be compressed. The refrigerant II starts to be further reduced in volume, be compressed, and guided to the discharge hole 326.

The refrigerant II is discharged from the discharge hole 326, and the refrigerant I flows as the region in which the two contact points between the fixed wrap 323 and the orbiting wrap 333 exist moves in a clockwise direction, and the volume of the refrigerant I decreases and starts to be compressed more.

As the region in which the two contact points between the fixed wrap 323 and the orbiting wrap 333 exist moves again in the clockwise direction to be closer to an interior of the fixed scroll, the volume of the refrigerant I further decreases and the refrigerant II is almost discharged.

As such, as the orbiting scroll 330 orbits, the refrigerant may be compressed linearly or continuously while flowing into the fixed scroll.

Although the drawing shows that the refrigerant flows into the inflow hole 325 discontinuously, this is for illustrative purposes only, and the refrigerant may be supplied continuously. Further, the refrigerant may be accommodated and compressed in each region where the two contact points between the fixed wrap 323 and the orbiting wrap 333 exist.

Figures 4A, 4B:
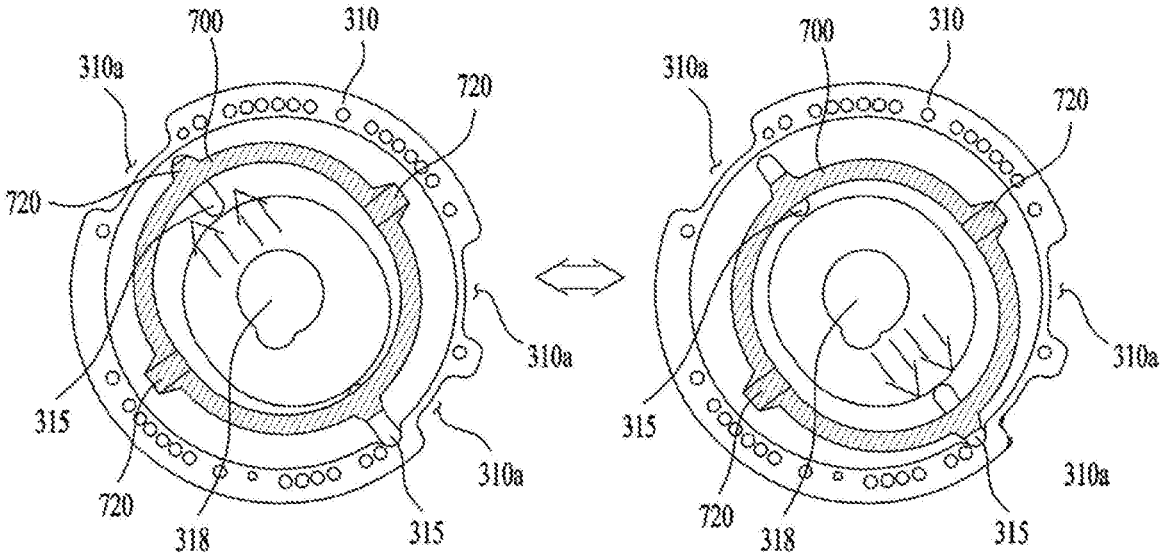
FIGS. 4A and 4B illustrate an example of operating structures of an Oldham's ring of a compressor.

FIGS. 4A and FIG. 4B illustrate an example of a structure and an operating scheme of an Oldham's ring.

Referring to FIG. 4A, the Oldham's ring of the compressor may include a ring body 710 disposed between the orbiting scroll 330 and the main frame 310, and a plurality of keys 720 protruding from the ring body and coupled to the orbiting scroll and the main frame.

The ring body 710 may be accommodated in an inner circumferential surface of the main side plate 312 of the main frame. The keys 720 protruding from the ring body 710 toward the main frame may be respectively inserted into a plurality of main key grooves 315 defined in the main frame symmetrically with respect to the rotation shaft.

The main key groove 315 may extend radially relative to the main shaft receiving portion 318 or the rotation shaft 230. As the key 720 may move from one end of the main key groove 315 to the other end thereof, and the ring body 710 may move.

The keys 720 protruding from the ring body 710 in a direction away from the orbiting scroll 330 or the main frame 310 may be respectively inserted into a plurality of orbiting key grooves defined in the orbiting scroll 330. The plurality of orbiting key grooves may be defined to be vertically spaced apart from the main key grooves 315, respectively.

Each of the keys 720 may be disposed at one end of each of the plurality of main key grooves 315.

Referring to FIG. 4B, when the rotation shaft 230 rotates, the orbiting scroll 330 starts to move, and thus a force may be applied to the Oldham's ring 700. Accordingly, the key 720 of the Oldham's ring may move to the other end of the main key groove 315. As a result, the Oldham's ring 700 may move in a straight line along an extension direction of the main key groove 315. When the rotation shaft 230 rotates further, the key 720 may move back to one end of the main key groove 315 again.

In some examples, the Oldham's ring 700 may reciprocate the orbiting scroll 330 along the extension direction of the main key groove 315 simultaneously while reciprocating the main key groove 315.

In this process, the orbiting scroll 330 may reciprocate symmetrically in the main key groove 315 as one end and the other end of the orbiting key groove are sequentially brought into contact with the key 720 based on rotation of a bearing portion 232 of the rotation shaft.

In some examples, the orbiting scroll 330 may orbit the fixed scroll 320 while reciprocating along the extension direction of the main key groove 315 and at the same time the reciprocating along an extension direction of the orbiting key groove, which is perpendicular to the extension direction of the main key groove 315.

For example, the orbiting scroll 330 may reciprocate with respect to two axes of the main key groove 315 and the orbiting key groove, but may be prevented from rotating relative to the rotating shaft.

In one example, when the orbiting scroll 330 is prevented from rotating but is able to orbit, the main key groove 315 and the orbiting key groove may not be defined vertically.

Figure 5:
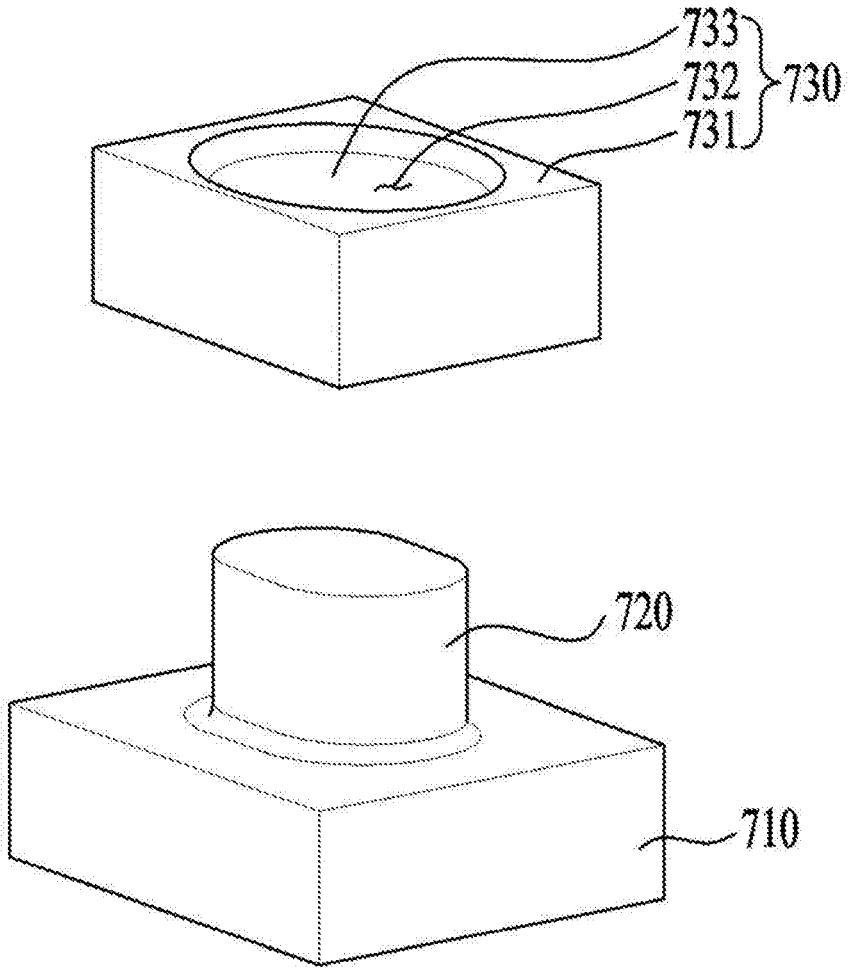
FIG. 5 illustrates an example structure of an Oldham's ring.

FIG. 5 illustrates an example of a cap coupled to a key of an Oldham's ring.

The key 720 may protrude from the ring body 710. The key 720 may be formed in a shape of a cylinder or an elliptic cylinder, or in a shape of a polyhedral pillar. Because the key 720 is directly rubbed with the main frame or the orbiting scroll, a durability needs to be ensured. However, it is inefficient to make the entire ring body 710 with a durable material, so that it may be desirable to couple a separate component made of a material having excellent durability, heat resistance, or rigidity to the key 720.

Accordingly, the Oldham's ring 700 may further include a cap 730 coupled to the key 720 and directly inserted into and being in contact with the orbiting scroll or the main frame. The cap 730 may be made of a material that is superior in the rigidity, durability, and heat resistance than the Oldham's ring 700 to prevent denaturation or deformation even under high temperature and high pressure.

The cap 730 may include a cap body 731 constituting a main body and a coupling hole 732 through which the key 720 may be inserted and coupled passing through the cap body 731. In some examples, the cap body 731 may further include a machined portion 733 that may minimize a residual stress in a process of being coupled to the key 720.

The machined portion 733 may be formed in the cap body 731 to be spaced apart from at least a portion of an outer circumferential surface of the key 720. Specifically, the machined portion 733 may extend outwardly from at least one of both ends of the coupling hole 732 such that a diameter or a size of the machined portion 733 is to be larger than that of the coupling hole 732. In some examples, the machined portion 733 may be a portion of an inner surface of the cap 730 that is ground, cut, recessed, or punched through.

The machined portion 733 may reduce the residual stress on the key 720 by reducing a contact area between the cap body 731 and the key 720. In addition, the machined portion 733 may be larger than a thickness or the diameter of the key 720 so as not to prevent the key 720 from being inserted into the coupling hole 732.

It may be prevented beforehand by the machined portion 733 that a portion of burr or flash generated when the coupling hole 732 is defined in the cap body 731 is exposed into the coupling hole 732 and interrupts the insertion of the key 720.

The machined portion 733 may be formed to be inclined linearly and outwardly of the cap body 731 at the both ends of the coupling hole 732. In addition, the machined portion 733 may be formed to be curved outwardly of the cap body 731 at the both ends of the coupling hole 732. Specifically, the machined portion 733 may be formed to be convex downward. In one example, the machined portion 733 may be formed to be convex upward.

Thus, even when the outer circumferential surface of the key 720 is in contact with the machined portion 733, the key 720 may be induced to be inserted into the coupling hole 732.

Figure 6A:
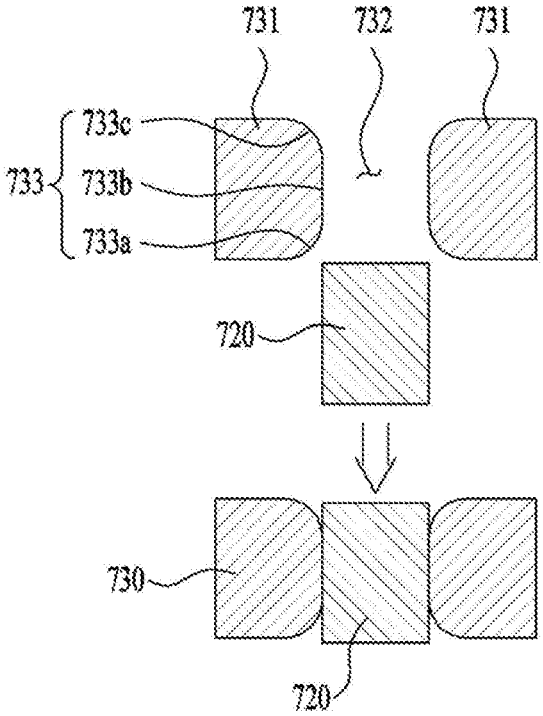
FIGS. 6A and 6B illustrate examples of cross-sectional structures and coupling structures of an Oldham's ring.
Figure 6B:
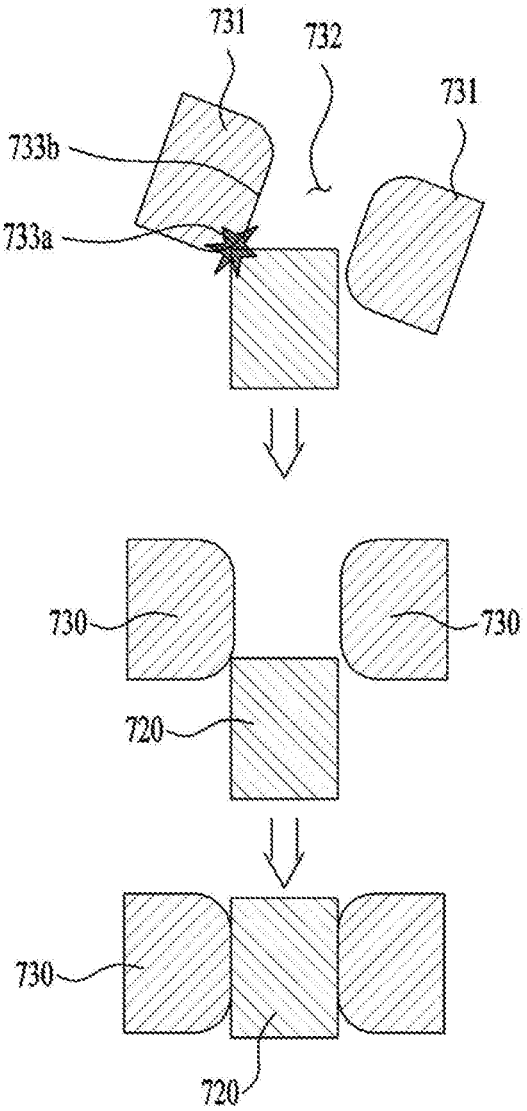

FIGS. 6A and 6B illustrate examples of structures and a coupling process of the key 720 and the cap 730 of the compressor.

Referring to FIG. 6A, the machined portion 733 may include a contact portion 733*b* formed to be in surface contact with the key 720.

The machined portion 733 may include an insertion curved portion 733*a* extending from the contact portion 733*b* to one end of the coupling hole to induce the insertion of the key. The insertion curved portion 733*a* may be formed at a portion of the coupling hole 732 where the key 720 starts to be inserted. The insertion curved portion 733*a* may be formed to have a cross section convex downward. The insertion curved portion 733*a* may be curved to prevent the key 720 from being caught in a portion where the contact portion 733*b* and the insertion curved portion 733*a* are connected to each other. The insertion curved portion 733*a* may extend the diameter of the coupling hole 732 to induce the key 720 to be inserted smoothly. In addition, because the insertion curved portion 733*a* is spaced apart from the key 720, occurrence of the residual stress of the key 720 may be minimized. In one example, the insertion curved portion 733*a* may be formed to have a cross section linearly inclined.

The machined portion 733 may include a relief curved portion 733*c* extending from the contact portion 733*b* to the other end of the coupling hole to reduce the residual stress of the key 720. The relief curved portion 733*c* may be formed at a portion of the coupling hole 732 where a free end of the key is exposed. The relief curved portion 733*c* may be formed to have a cross section convex upward. The relief curved portion 733*c* may be curved to prevent the key 720 passed through the contact portion 733*b* from being caught. The relief curved portion 733*c* may be formed to extend the diameter of the coupling hole 732 such that the free end of the key 720 is spaced apart from the cap 730. Therefore, the residual stress at the free end of the key 720 may be solved.

The machined portion 733 may include at least one of the contact portion 733*b*, the insertion curved portion 733*a*, and the relief curved portion 733*c*.

As shown in FIG. 6A, the cap 730 may be disposed in place such that the coupling hole 732 may correspond to the key 720. In some examples, the cap 730 may be pressed and coupled toward the ring body 710 from the free end of the key 720.

In some examples, the compressor may relieve a residual stress at a fixed end of the key 720 using the insertion curved portion 733*a*. In addition, the compressor may relieve the residual stress at the free end portion of the key 720 using the relief curved portion 733*c*. Thus, even when the contact portion 733*b* is close contact with the key 720 and fixed tightly, the residual stress of the key 720 may be minimized to ensure durability and stability of the key 720.

Referring to FIG. 6B, the cap 730 may be disposed to be inclined to the key 720 or the coupling hole 732 may be spaced apart from the key 720 by a certain distance. In this process, the cap 730 may be forcibly pressed toward the key 720.

In the compressor, the cap 730 includes the machined portion 733, so that as long as the free end of the key 720 is in contact with the machined portion 733, the key 720 may be induced to be inserted into the coupling hole 732.

In other words, when one side of the free end of the key 720 is in contact with the insertion curved portion 733*a*, one side of the free end of the key 720 may be moved along one face of the insertion curved portion 733*a* and guided to the contact portion 733*b*. In this process, the cap 730 and the key 720 may be respectively disposed in place. Accordingly, the other side of the free end of the key 720 may be guided to the contact portion 733*b*. As a result, the key 720 may be inserted into the cap 730 normally, and the key 720 may be prevented from being deformed while being coupled to the cap 730.

An outer circumferential surface of the free end of the key 720 may be machined such that a diameter or a thickness of the free end of the key 720 are smaller than that of the key 720.

Figures 7A, 7B, 7C:
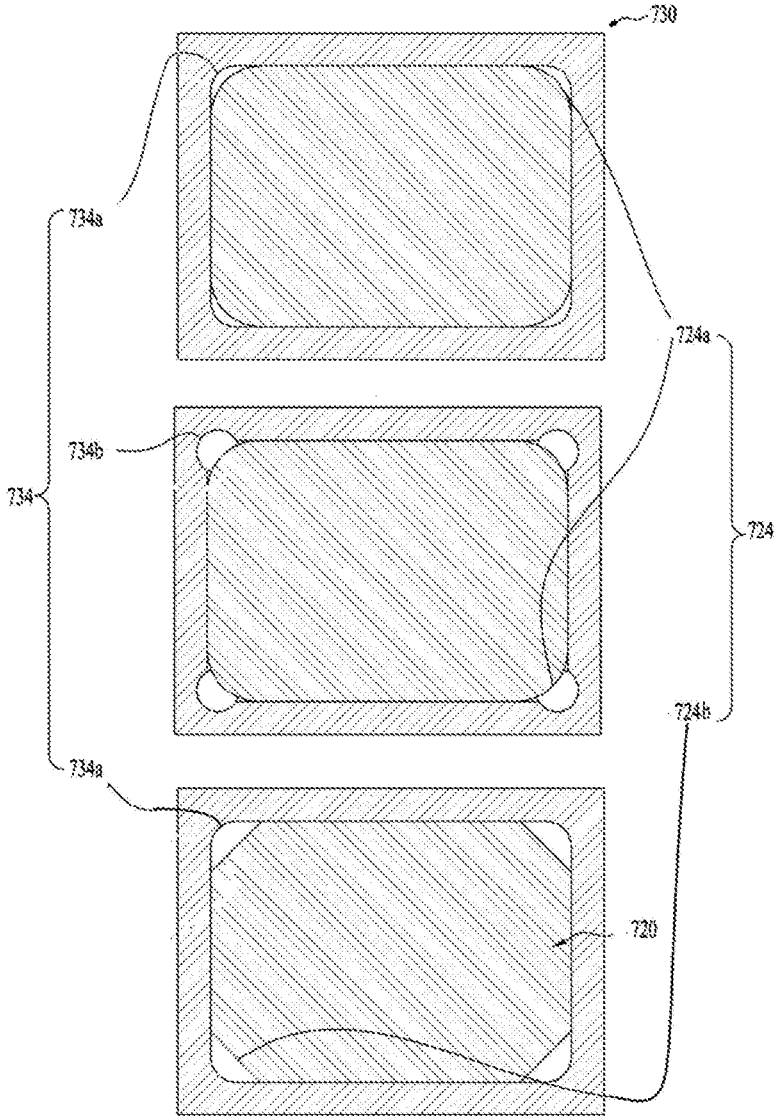
FIGS. 7A to 7C illustrate examples of contact avoidance structures of example Oldham's rings.

FIGS. 7A to 7C illustrate an example of an Oldham's ring.

The machined portion 733 of the cap 730 of the Oldham's ring shown in FIGS. 7A to 7C may further include a coupling gap spaced apart from an entire outer surface of the key. The coupling gap 734 may extend along a thickness direction of the coupling hole 732. That is, the coupling gap 734 may be defined to be spaced apart from the key 720 from one end to the other end of the coupling hole 732. Accordingly, the coupling gap 734 may completely space a portion of the coupling hole 732 from the key 720 in a height direction, unlike the insertion curved portion 733*a* or the relief curved portion 733*c*.

The key 720 may have a polygonal cross section or a cross section of a shape of a combination of a straight line and a curved line. The key 720 may include at least one vertex which has an outer surface having an angle that changes drastically. This is to prevent the cap 730 from rotating around the key 720. However, an excessive residual stress may be concentrated at the vertex of the key 720, and the cap 730 may provide a strong friction force when being coupled to the key 720. In addition, when a position of the vertex of the key 720 and a position of the coupling hole 732 do not match, the insertion of the cap 730 may be disturbed.

Accordingly, the cap 730 includes the coupling gap 734 such that the cap 730 may be spaced apart from the vertex of the key 720. As a result, the cap 730 may prevent beforehand the vertex of the key 720 from being excessively rubbed or deformed when being inserted into the coupling hole 732. In addition, the cap 730 may block concentration of excessive residual stress on the vertex of the key 720. Further, the cap 730 may be sufficiently coupled to the key 720 even when the coupling hole 732 does not correspond exactly to the vertex of the key 720.

The coupling gap 734 may be defined to extend outwardly of the cap 730 from the coupling hole 732.

In some implementations, the key may include an avoiding portion 724 formed by processing a portion of the outer circumferential surface of the key to prevent contact with the cap. The avoiding portion 724 may be formed to extend in a longitudinal direction of the key 720. For example, the avoiding portion 724 may be a corner or edge of the key 720. The corner or edge may be curved or chamfered to avoid, that is, to be spaced apart from an inner corner of the cap 730.

Thus, because of at least one of the avoiding portion 724 and the coupling gap 734, an area where the key and the cap are in contact with each other is minimized, and simultaneously, the vertex of the key and a vertex of the coupling hole may be fundamentally prevented from colliding or rubbing with each other.

Referring to FIG. 7A, the coupling gap 734 may include a curved portion 734*a* having a radius of curvature smaller than that of the vertex of the key in the coupling hole. Thus, the curved portion 734*a* may always be spaced apart from the vertex of the key. In some examples, the coupling gap 743 may refer to a portion of the inner surface of the cap 730. In some examples, the coupling gap 743 may refer to a portion of a space defined between an inner corner of the cap 730 and a vertex of the key 720.

In some examples, the avoiding portion 724 may include a curved avoiding portion 724*a* formed such that a cross-sectional vertex of the key has a radius of curvature greater than that of one face of the coupling hole that faces the cross-sectional vertex of the key. That is, the curved avoiding portion 724*a* may have a radius of curvature greater than that of the curved portion 734*a*.

Referring to FIG. 7B, the coupling gap 734 may include a recessed portion 734*b* recessed outwardly of the cap than the vertex of the key 720 from the coupling hole 732. The recessed portion 734*b* may be recessed so as not to form a continuous face in an inner circumferential surface of the coupling hole 732. That is, the recessed portion 734*b* may be defined in a groove shape to have a radius of curvature smaller than that of the coupling hole 732.

Referring to FIG. 7C, the avoiding portion 724 may include an inclined avoiding portion 724*b* formed by chamfering the cross-sectional vertex of the key. Because of the inclined avoiding portion 724*b*, the contact area between the key 720 and the cap 730 may be minimized, so that the residual stress may be effectively eliminated.

In addition, a contact force of the outer surface of the key and the coupling hole 732 except for the inclined avoiding portion 724*b* may be greatly improved.

Figure 8:
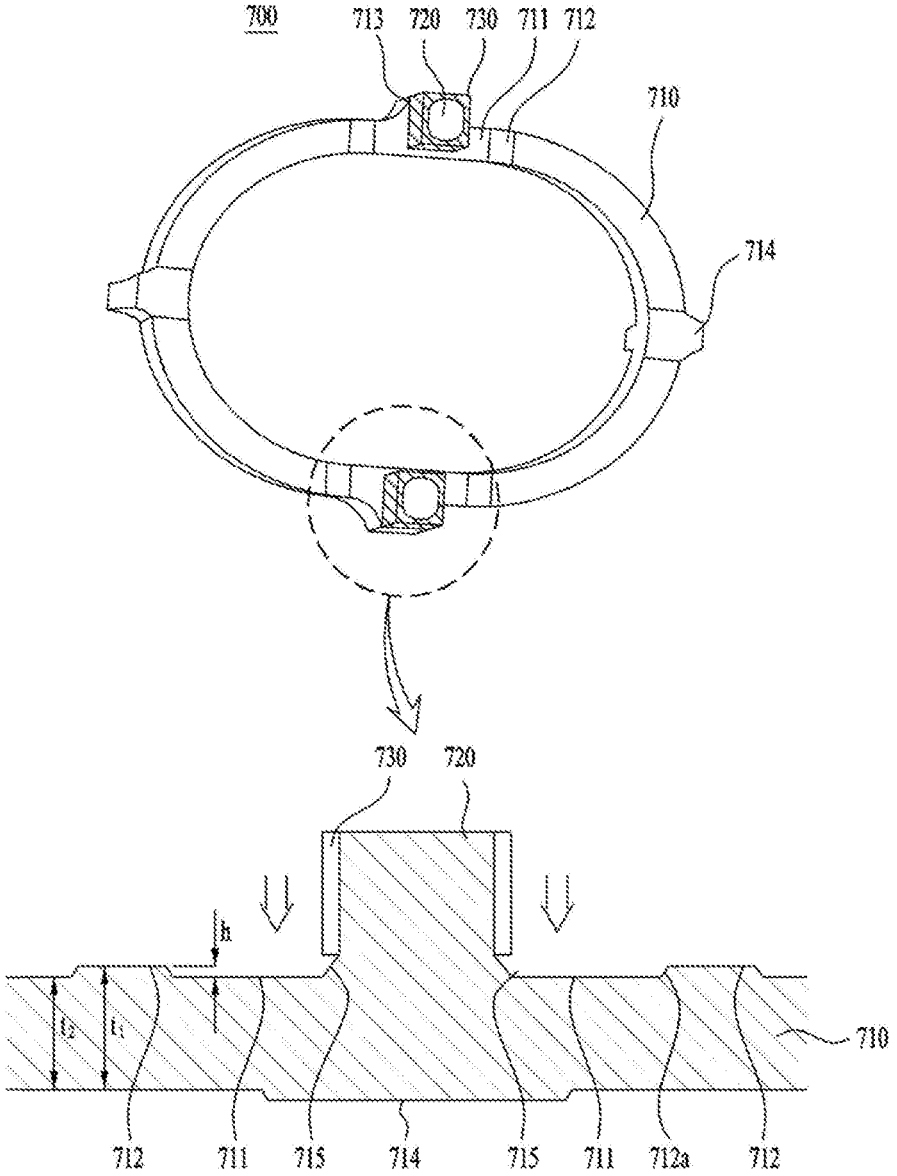
FIG. 8 illustrates an example of a ring body of an Oldham's ring.

FIG. 8 illustrates an example of an Oldham's ring.

The ring body 710 may be formed in a shape through which the rotation shaft 230 passes or the back pressure seal 350 may be accommodated therein. The ring body 710 may be formed in a circular or elliptical shape or in a track shape.

Each key 720 may protrude from one face or the other face of the ring body 710, and may protrude at a point corresponding to a long or short axis of the ring body 710. The key 720 may protrude from one face of the ring body 710 to be coupled to the main frame, or protrude from the other face of the ring body 710 to be coupled to the orbiting scroll.

The ring body 710 may include an inclined portion 715 formed at a portion where each of the plurality of keys 720 protrudes such that the ring body 710 is spaced apart from the cap 730 even when the cap 730 is completed to the key 720.

The inclined portion 715 may extend outward of a portion of the key 720 in contact with the cap 730 around the key 720. That is, the inclined portion 715 may be extended to have a diameter of a thickness larger than that of the key 720 at the fixed end of the key 720.

Thus, even when the cap 730 is coupled to the key 720, an end of the cap 730 may be prevented from being in contact with the ring body 710. As a result, in the process that the cap 730 is coupled to the key 720, even when the cap 730 is pressed toward the ring body 710, the cap 730 does not in contact with the ring body 710, thereby preventing the occurrence of the burr.

In one example, the ring body 710 may include a recess 711 recessed at a portion outward of the inclined portion 715 and spaced apart from the cap 730. That is, the recess 711 may be recessed inwardly of the ring body 710 so as to be completely spaced apart from the cap 730. Therefore, the recess 711 may have thickness less than a thickness h of the inclined portion 715. Each recess 711 may be defined at each of both sides of each of the plurality of keys 720. A width of the recess 711 may correspond to a width of the ring body 710.

The width of the recess 711 may be best suited to be 1/10 of the thickness of the cap 730.

Thus, the cap 730 and the ring body 710 may be spaced apart by a spacing "h" due to the height of the inclined portion. As a result, in the process that the cap 730 is coupled to the key 720, even when the cap 730 is pressed toward the ring body 710, the cap 730 does not in contact with the ring body 710, so that the occurrence of the burr may be completely blocked.

The recess 711 may be defined such that the both sides of the key 720 may be maintained at a thickness t2 of the ring body 710. In addition, a thickness of the recess 711 may be less than the thickness t2 of the ring body 710.

Therefore, in the ring body 710, a thrust face that has a thickness larger than that of the ring body 710 may be omitted at the both sides of the key 720 because of the recess 711. As a result, a weight of the Oldham's ring may be reduced, so that the efficiency of the compressor may be increased.

In addition, the ring body 710 may further include a support protrusion 712 protruding such that the support protrusion 712 is extended from the recess 711 in a direction away from the key to be in contact with the main frame or the orbiting scroll. The thickness t1 of the support protrusion 712 may be greater than the thickness t2 of the ring body 710. The thickness t1 of the support protrusion 712 may correspond to the height h of the inclined portion.

Figure 9:
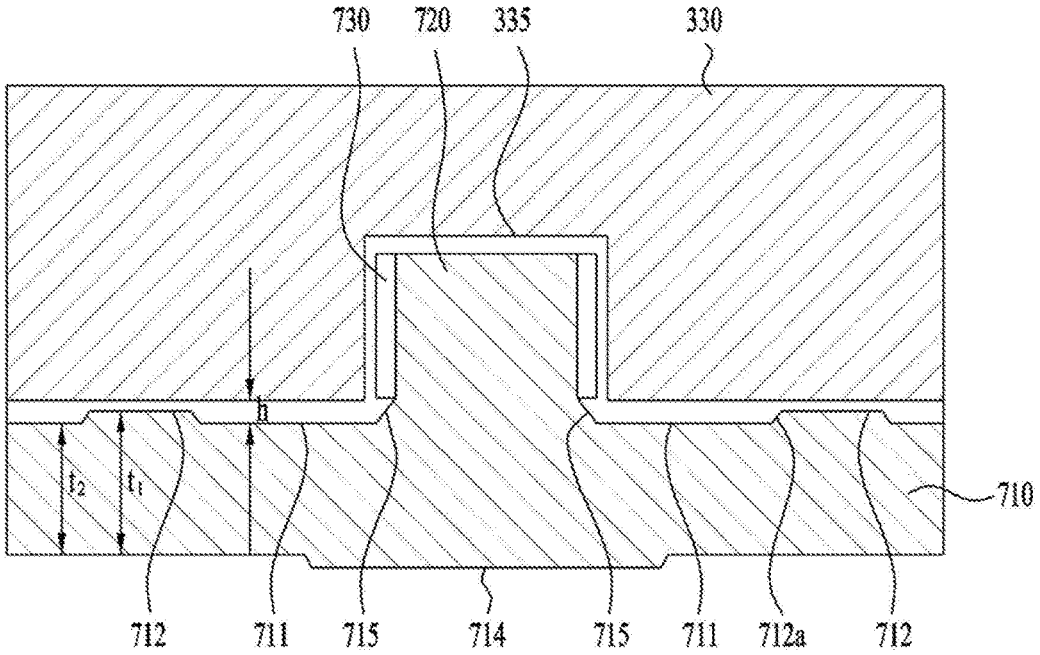
FIG. 9 is a cross-sectional view illustrating an example of an Oldham's ring that is coupled to a main frame or an orbiting scroll.

FIG. 9 is a cross-sectional view illustrating an example of an orbiting scroll that is coupled to the Oldham's ring shown in FIG. 8. This is for illustrative purposes only, even when the Oldham's ring is coupled to the main frame, it may be the same as the cross section.

Referring to FIG. 9, the cap 730 is coupled to the key 720 of the Oldham's ring 700, and the cap 730 may be inserted into an orbiting key groove 335 defined in the orbiting scroll while receiving the key 720 therein.

Even when the orbiting scroll 330 presses the cap 730 and the key 720 toward the ring body 710 by a back pressure, the cap 730 may always be spaced apart from the ring body 710 due to the inclined portion 715 and recess 711.

Even when the orbiting scroll 330 presses the cap 730 and the key 720 toward the ring body 710 by the back pressure, one face of the orbiting scroll 330 and the ring body 710 may always be spaced apart by h because of the support protrusion 712. In some examples, only the support protrusion 712 may be in contact with one face of the orbiting scroll 330 to rub against the orbiting scroll 330.

In one example, the support protrusion 712 may further include each protruding inclined face 712*a* disposed to be inclined at each of both sides of the support protrusion 712.

The protruding inclined face 712*a* may be formed to have an inclination equal to an inclination of the inclined portion 715 or may have an inclination in a direction opposite to the inclination of the inclined portion 715. Thus, the recess 711 may be easily defined in the ring body 710.

In addition, the ring body 710 may include a protruding portion 714 protruding from a face, which is opposite to a portion where the key 720 protrudes. Thus, a rigidity of the ring body 710 may be maintained even with a load applied to the key 720.

Effects as not described herein may be derived from the above configurations.

In addition, embodiments shown in the drawings may be modified and implemented in other forms. The modifications should be regarded as falling within a scope when the modifications is carried out so as to include a component claimed in the claims or within a scope of an equivalent thereto.

What is claimed is:

1. A compressor comprising:

a casing including a discharger for discharging a refrigerant on one side;

a drive unit coupled to an inner circumferential face of the casing to rotate a rotation shaft; and a compression unit coupled to the rotation shaft and configured to compress the refrigerant, the compression unit comprising:

a fixed scroll configured to receive and discharge the refrigerant, an orbiting scroll that is engaged with the fixed scroll, that is coupled to the rotation shaft, and that is configured to orbit relative to the fixed scroll based on rotation of the rotation shaft to thereby compress the refrigerant in the fixed scroll, a main frame that is disposed on the fixed scroll, that accommodates the orbiting scroll therein, wherein the rotation shaft passes through the main frame, and an Oldham's ring that is coupled to the orbiting scroll and to the main frame and that is configured to restrict rotation of the orbiting scroll, wherein the Oldham's ring comprises:

a ring body disposed between the orbiting scroll and the main frame, a plurality of keys that protrude from the ring body, each of the plurality of keys being coupled to the orbiting scroll or the main frame, and a plurality of caps that are inserted into the orbiting scroll or the main frame, each of the plurality of caps having a coupling hole that receives a key among the plurality of keys and that has a machined portion disposed at at least one of ends of the coupling hole and spaced apart from at least a portion of an outer surface of the key, wherein the ring body comprises an inclined portion that is disposed at a boundary between the ring body and the key, and wherein a width of the inclined portion is greater than a width of the coupling hole to thereby separate a cap of the plurality of caps from the ring body.

2. The compressor of claim 1, wherein the ends of the coupling hole include a first end that faces the orbiting scroll or the main frame and a second end that faces the ring body, and wherein the machined portion extends outward from at least one of the first end of the coupling hole or the second end of the coupling hole.

3. The compressor of claim 1, wherein the ends of the coupling hole include a first end that faces the orbiting scroll or the main frame and a second end that faces the ring body, and wherein the machined portion comprises:

a contact portion that defines an inner circumferential surface of the coupling hole and is disposed between the first end of the coupling hole and the second end of the coupling hole, that is in surface contact with the key, and that is coupled to the key; and an insertion curved portion that extends from the contact portion to one of the first end of the coupling hole or the second end of the coupling hole and that guides insertion of the key into the coupling hole.

4. The compressor of claim 1, wherein the ends of the coupling hole include a first end that faces the orbiting scroll or the main frame and a second end that faces the ring body, and wherein the machined portion comprises:

a contact portion that defines an inner circumferential surface of the coupling hole and is disposed between the first end of the coupling hole and the second end of the coupling hole, that is in surface contact with the key, and that is coupled to the key, and a relief curved portion that extends from the contact portion to one of the first end of the coupling hole or the second end of the coupling hole and that is configured to reduce a residual stress of the key.

5. The compressor of claim 1, wherein the machined portion defines a coupling gap that extends outward from a portion of the coupling hole and that is spaced apart from the outer surface of the key.

6. The compressor of claim 5, wherein the coupling gap extends through the coupling hole in a direction from the ring body to the main frame.

7. The compressor of claim 6, wherein the coupling gap comprises a recessed portion that extends outward from the coupling hole relative to a vertex of the key.

8. The compressor of claim 6, wherein the machined portion comprises a curved portion that defines the coupling gap, and wherein a radius of curvature of the curved portion is less than a radius of curvature of a vertex of the key.

9. The compressor of claim 1, wherein the outer surface of the key is configured to avoid contact with one of the plurality of caps based on the key being inserted into the coupling hole.

10. The compressor of claim 9, wherein an edge of the outer surface of the key is curved or chamfered and is spaced apart from a corner of the coupling hole.

11. The compressor of claim 1, wherein the inclined portion is inclined with respect to a side surface of the key facing an inner circumferential surface of the coupling hole, the inner circumferential surface defining the width of the coupling hole, and wherein the inclined portion has a first end that is in contact with an end of the inner circumferential surface of the cap and a second end that extends from the first end to a surface of the ring body, the second end defining the width of the inclined portion and being spaced part from the cap.

12. A compressor comprising:

a casing including a discharger for discharging a refrigerant on one side;

a drive unit coupled to an inner circumferential face of the casing to rotate a rotation shaft; and a compression unit coupled to the rotation shaft and configured to compress the refrigerant, the compression unit comprising:

a fixed scroll configured to receive and discharge the refrigerant, an orbiting scroll that is engaged with the fixed scroll, that is coupled to the rotation shaft, and that is configured to orbit relative to the fixed scroll based on rotation of the rotation shaft to thereby compress the refrigerant in the fixed scroll, a main frame that is disposed on the fixed scroll, that accommodates the orbiting scroll therein, and that receives the rotation shaft, and an Oldham's ring that is coupled to the orbiting scroll and the main frame and that is configured to restrict rotation of the orbiting scroll, wherein the Oldham's ring comprises:

a ring body that is disposed between the orbiting scroll and the main frame and that receives the rotation shaft, a plurality of keys that protrude from the ring body, each of the plurality of keys being coupled to the orbiting scroll or to the main frame, and a plurality of caps inserted into the orbiting scroll or the main frame, each of the plurality of caps defining a coupling hole that accommodates a key among the plurality of keys, wherein each of the plurality of keys comprises an avoiding portion that is spaced apart from an inner surface of a cap of the plurality of caps that defines the coupling hole, wherein the ring body comprises an inclined portion that is disposed at a boundary between the ring body and a key of the plurality of keys, and wherein a width of the inclined portion is greater than a width of the coupling hole to thereby separate the cap from the ring body.

13. The compressor of claim 12, wherein the avoiding portion comprises:

a chamfer that is disposed at a vertex of the key and that is inclined with respect to the inner surface of the cap.

14. The compressor of claim 12, wherein the avoiding portion comprises a curved portion disposed at a vertex of the key, and wherein a radius of curvature of the curved portion is greater than a radius of curvature of a corner of the coupling hole that faces the vertex of the key.

15. The compressor of claim 12, wherein the avoiding portion extends along a longitudinal direction of the key toward the ring body.

16. The compressor of claim 12, wherein the plurality of keys comprise:

a first plurality of keys that protrude from a first surface of the ring body and that are coupled to the main frame; and a second plurality of keys that protrude from a second surface of the ring body opposite to the first surface and that are coupled to the orbiting scroll, and wherein the first plurality of keys and the second plurality of keys are alternately arranged along the ring body.

17. A compressor comprising:

a casing including a discharger for discharging a refrigerant on one side;

a drive unit coupled to an inner circumferential face of the casing to rotate a rotation shaft; and a compression unit coupled to the rotation shaft and configured to compress the refrigerant, the compression unit comprising:

a fixed scroll configured to receive and discharge the refrigerant, an orbiting scroll that is engaged with the fixed scroll, that is coupled to the rotation shaft, and that is configured to orbit relative to the fixed scroll based on rotation of the rotation shaft to thereby compress the refrigerant in the fixed scroll, a main frame that is disposed on the fixed scroll, that accommodates the orbiting scroll therein, and that receives the rotation shaft, and an Oldham's ring that is coupled to the orbiting scroll and to the main frame and that is configured to restrict rotation of the orbiting scroll, wherein the Oldham's ring comprises:

a ring body disposed between the orbiting scroll and the main frame, a plurality of keys that protrude from the ring body, each of the plurality of keys being coupled to the orbiting scroll or to the main frame, and a plurality of caps that are inserted into the orbiting scroll or the main frame, each of the plurality of caps defining a coupling hole that accommodates a key among the plurality of keys, and wherein the ring body comprises:

an inclined portion that is disposed at a boundary between the ring body and each of the plurality of keys, a recess that is recessed from a surface of the ring body, that extends outward from the inclined portion, and that is spaced apart from the cap, and a support protrusion that protrudes from the surface of the ring body, that extends outward from the recess, and that is in contact with the main frame or the orbiting scroll, and wherein a width of the inclined portion is greater than a width of the coupling hole to thereby separate a cap of the plurality of caps from the ring body.

18. The compressor of claim 17, wherein the inclined portion extends outward relative to a portion of the key that is in contact with the cap.

19. The compressor of claim 17, wherein the recess is defined at both sides of each of the plurality of keys.

20. The compressor of claim 19, wherein a length of the recess along the ring body is greater than a thickness of the cap.

* * * * *